US007932868B2

(12) United States Patent
Legay et al.

(10) Patent No.: US 7,932,868 B2
(45) Date of Patent: Apr. 26, 2011

(54) REFLECTOR ARRAY ANTENNA WITH RECONFIGURABLE SHAPE COVERAGE WITH OR WITHOUT LOADER

(75) Inventors: Hervé Legay, Plaisance du Touch (FR); Béatrice Salome, Lanta (FR); Gérard Caille, Tournefeuille (FR); Jean-Didier Gayrard, Cugnaux (FR); Yoann Jacquet, Pibrac (FR)

(73) Assignee: Thales, Neuilly sur Seine (FR)

( * ) Notice: Subject to any disclaimer, the term of this patent is extended or adjusted under 35 U.S.C. 154(b) by 956 days.

(21) Appl. No.: 11/574,391

(22) PCT Filed: Jul. 21, 2005

(86) PCT No.: PCT/FR2005/050602

§ 371 (c)(1),
(2), (4) Date: Jun. 12, 2007

(87) PCT Pub. No.: WO2006/027509

PCT Pub. Date: Mar. 16, 2006

(65) Prior Publication Data

US 2007/0268192 A1 Nov. 22, 2007

(30) Foreign Application Priority Data

Aug. 31, 2004 (FR) ..... 04 51940

(51) Int. Cl.
*H01Q 13/00* (2006.01)

(52) U.S. Cl. ..... 343/781 P; 343/761; 343/763; 343/781 CA

(58) Field of Classification Search ..... 343/878, 343/879, 880, 881, 882, 781 P, 757, 763, 343/872, 761, 781 R, 781 CA
See application file for complete search history.

(56) References Cited

U.S. PATENT DOCUMENTS 6,031,506 A * 2/2000 Cooley et al. ..... 343/840
(Continued)

FOREIGN PATENT DOCUMENTS

EP 0 845 833 A2 6/1998
FR 2 648 278 12/1990

OTHER PUBLICATIONS

J. A. Encinar et al, Three-Layer Printed Reflectarrays for Contoured Beam Space Applications, IEEE Transactions on Antennas and Propagation, IEEE, Inc. New York, US, vol. 52, No. 5, May 2004, pp. 1138-1148, XP001195822.

(Continued)

*Primary Examiner* — Douglas W Owens
*Assistant Examiner* — Dieu Hien T Duong
(74) *Attorney, Agent, or Firm* — Sughrue Mion, PLLC

(57) ABSTRACT

A reflector network antenna (A) comprising i) a source (S) delivering wave signals; ii) at least two reflector networks (RR1-RR9) which are different and independent and which both comprise at least two phase shifter cells which selectively phase shift the waves delivered by the source (S) and bring about a selected frequency phase dispersion thereof, said selective phase shifting and selective dispersion varying from one reflector network to another; and iii) a charging device (DC) which is coupled to the reflector networks (RR1-RR9) and which is used to place one of them in a selected position in relation to the source (S) such that the waves that it delivers are phase shifted and phase dispersed at a frequency imposed by said phase shifter cells in order to be reflected in a selected direction.

30 Claims, 4 Drawing Sheets

U.S. PATENT DOCUMENTS

Figure 4:
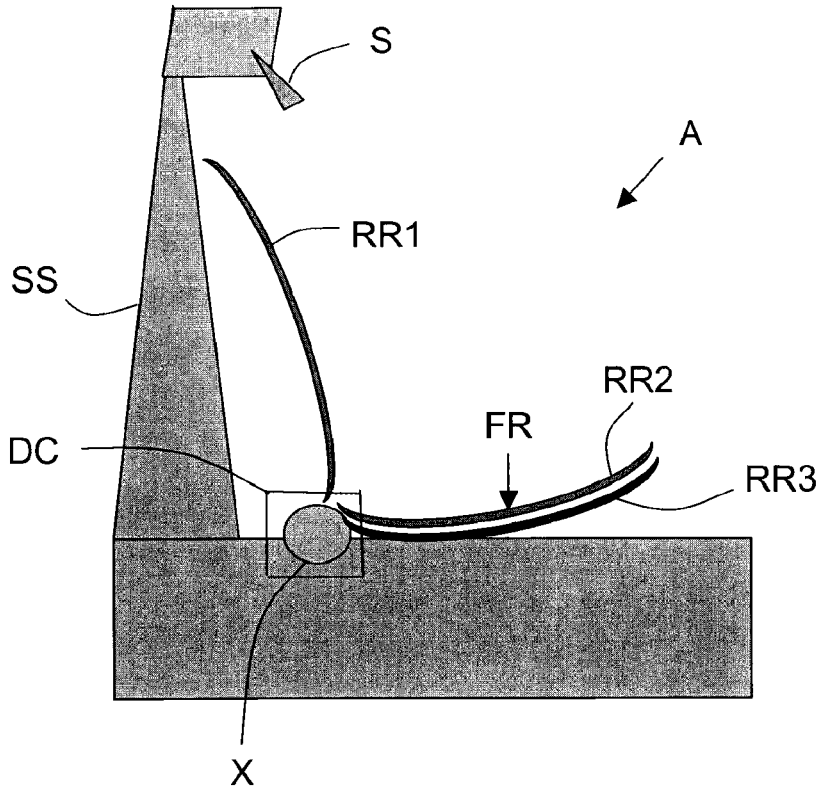

| | | | | |
|---|---|---|---|---|
| 6,239,763 | B1 | 5/2001 | Cuchanski | |
| 6,580,399 | B1 * | 6/2003 | Ballinger et al. | 343/781 P |
| 6,642,889 | B1 * | 11/2003 | McGrath | 343/700 MS |
| 6,774,851 | B1 | 8/2004 | Cuhaci | |
| 2001/0028328 | A1 * | 10/2001 | Stjernman et al. | 343/761 |

OTHER PUBLICATIONS

H. Legay et al, "A steerable relflectarray antenna with mems controls", IEEE International Symposium on Phased Array Systems and Technology 2003, Oct. 14-17, 2003, pp. 494-499, XP010676736.

* cited by examiner

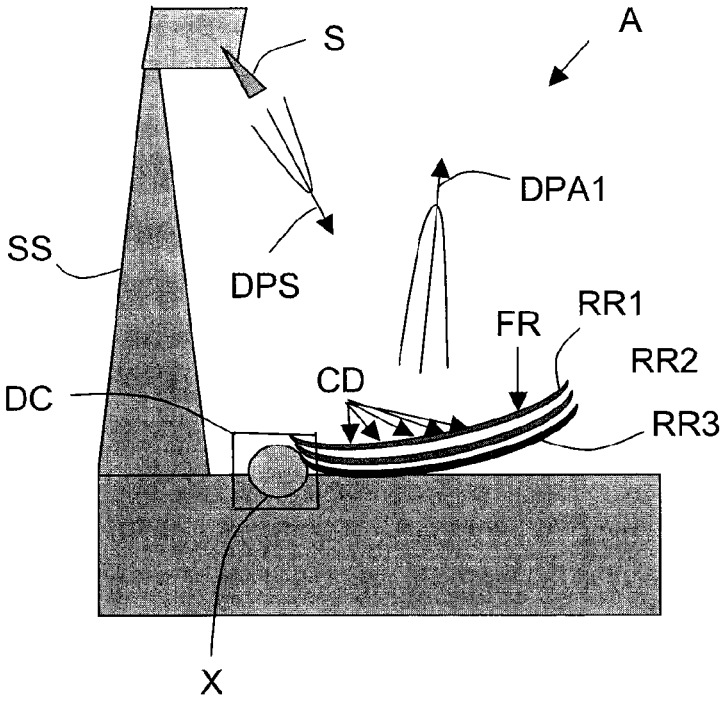
FIG.1
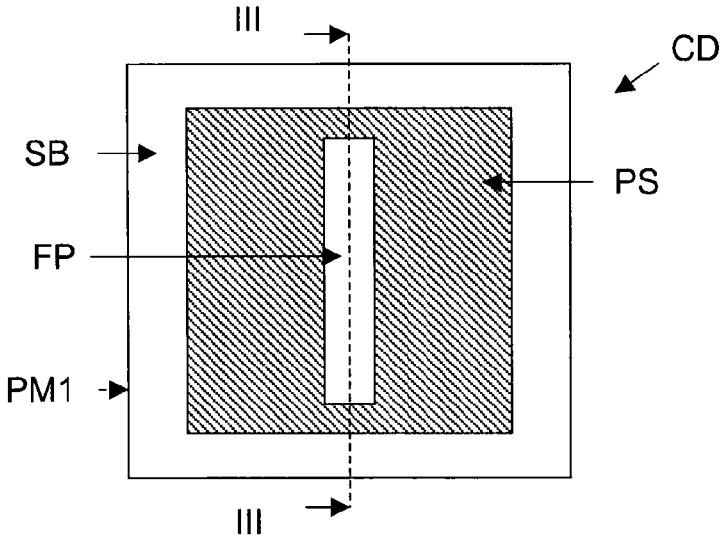
FIG.2
FIG.3
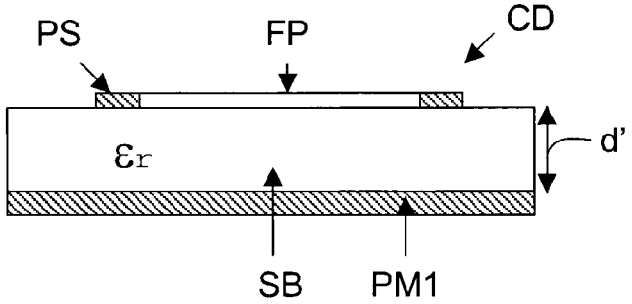

REFLECTOR ARRAY ANTENNA WITH RECONFIGURABLE SHAPE COVERAGE WITH OR WITHOUT LOADER

The invention concerns the field of onboard array antennas, for example onboard satellites, and more particularly reflector array antennas (or "reflector array antennas" [In English in the original—Tr.]).

As the man skilled in the art knows, reflector array antennas constitute one of the two main families of array antennas, the other family consisting of phased array antennas (or "phased array antennas" [In English in the original—Tr.]).

Here "reflector array antenna" means an antenna including radiating elements defining a reflector array and responsible for intercepting with minimum losses waves, including signals to be transmitted, delivered by a primary source, in order to reflect them in a chosen direction, called the pointing direction.

The array antennas cited above are of interest because they enable depointing of a beam radiating towards a given coverage area (or "spot"), in order to move from that coverage area to another. For example, in the case of a reflector array antenna depointing is effected by reconfiguring its antenna diagram by means of phase control devices associated with each of its radiating elements. It should be remembered that a phase control device constitutes with the associated radiating element a passive or active phase-shifter cell. Here "phase-shifter cell" means either a structure with a radiating cavity and a radiating slot or a resonant planar structure with a radiating patch (or "patch" [In English in the original—Tr.]).

Traffic evolving faster than the service life of a satellite, and sometimes even faster than the time necessary to produce the latter, it is important to be able to redefine a telecommunication mission during the production of the satellite and/or when it is already in orbit.

To enable the reconfiguration of the shape, as initially provided, of a coverage area, two solutions have been proposed.

A first solution consists in using array antennas known as active array antennas, for example those of DRA or FAFR type. The drawback of this solution lies in the fact that it necessitates particularly complex and costly antennas.

A second solution consists in using an antenna with two reflectors, one called the "sub-reflector" and being hyperbolic or elliptical (with the geometries known as "Cassegrain" or "Gregory") and having a common focus with the other reflector, called the "main" reflector, of (quasi-)parabolic type. In this case, the main reflector may be inclined. The drawback of this solution lies in the fact that it induces a defocusing of the beam and consequently degrades performance. Furthermore, this solution enables only reconfiguration of the pointing of the beam and does not enable modification of the shape of said beam.

A third solution uses, like the preceding one, an antenna with two reflectors and further includes a mechanism that can either move the sub-reflector (for example by pivoting it about its axis of revolution, when it has an elliptical profile), or replacing one sub-reflector with another, conformed differently (if two or three sub-reflectors are mounted around a common mast). The drawback of this solution lies in particular in the fact that the number of sub-reflectors is limited (typically to two or three) because they are conformed differently and very bulky, and therefore cannot be stacked.

No solution known in the art proving entirely satisfactory, in terms of cost/reconfiguration capacity ratio and/or in terms of flexibility of the coverage offered (either before the start of a mission or once it has commenced), the invention therefore has the aim of improving upon the situation.

To this end it proposes a reflector array antenna comprising:

- a source delivering signals in the form of waves,
- at least two different and independent reflector arrays each comprising at least two phase-shifter cells responsible for imposing on the waves delivered by the source a chosen phase-shift and (as far as possible) a chosen frequency-phase dispersion, this chosen phase-shift and/or this chosen dispersion varying from one reflector array to the other, and
- a loading device coupled to the reflector arrays and responsible for placing one of them in a chosen position relative to the source so that the waves that it delivers are subjected to the phase-shift and the frequency-phase dispersion imposed by its phase-shifter cells, so as to be reflected in a chosen direction, generating a lobe of required shape (either by radiation followed by a single reflection or by radiation followed by two reflections, one of which is from a main reflector).

The antenna according to the invention may have other features and in particular, separately or in combination:

- its reflector arrays may have a substantially planar or substantially parabolic wave-reflecting face when they serve as a main "reflector" or a substantially planar, substantially elliptical or substantially hyperbolic wave-reflecting face when they serve as a secondary reflector (i.e. when there is a main reflector),
- its loading device may include at least one shaft on which the reflector arrays are mounted to rotate at different angular positions enabling them to be positioned substantially one above the other in an initial position and responsible for driving at least one of the reflector arrays selectively in rotation about this shaft so as to place it in the chosen position. Alternatively, the loading device may include at least one housing (or magazine) in which the reflector arrays are stored and "holding" and displacement means responsible for seizing selectively one of the reflector arrays in the housing so as to extract it from the latter and then to place it in the chosen position,
- the phase-shifter cells of at least one of the reflector arrays may be of passive type. In this case, for example, each of them includes a substantially planar resonant structure comprising at least one upper patch placed substantially parallel to a lower ground plane, at a chosen distance, and including at least one slot, the dimensions of the patch and of the slot and the distance being chosen to impose the chosen phase-shift and the chosen frequency-phase dispersion on the waves to be reflected,
- the phase-shifter cells of at least one of the reflector arrays may be of active type. In this case, for example, each of them may have a characteristic resonant length and comprise in at least one chosen location a micron-scale scale electromechanical device, of MEMS type, adapted to be placed in at least two different states respectively allowing and prohibiting the establishing of a short circuit intended to vary the resonant length, so as to vary the phase-shift applied to the waves to be reflected in the chosen direction,
- at least one main reflector responsible for reflecting in a pointing direction of a chosen area the waves that are reflected in the chosen direction by the reflector array that is placed in the chosen position,
  - each main reflector may have a substantially parabolic wave-reflecting face (if it is of conventional type (non-etched reflecting face)), or a substantially parabolic or plane wave-reflecting face (if said reflecting face includes an etched reflector array), when there are at least two main reflectors, having different optical characteristics adapted to reflect in different pointing directions the waves reflected in the chosen direction by the reflector array (placed in the chosen position), it includes another loading device, coupled to the main reflectors and responsible for placing one of them in a chosen position relative to the reflector array (placed in the chosen position), so as to reflect the waves reflected by that reflector array in its pointing direction, this other loading device may for example include at least one shaft on which the main reflectors are mounted to rotate at different angular positions enabling them to be positioned substantially one above the other in an initial position, and it may be responsible for driving at least one of the main reflectors selectively in rotation about this shaft so as to place it in the chosen position, alternatively, the other loading device may for example include at least one housing (or magazine) in which the main reflectors are stored and holding and displacement means adapted to seize selectively one of the main reflectors in the housing so as to extract it from the latter and then to place in the chosen position.

The invention also proposes a reflector array antenna comprising:

a source delivering signals in the form of waves, a reflector array comprising at least two phase-shifter cells responsible for imposing on the waves delivered by the source a chosen phase-shift and (as far as possible) a chosen frequency-phase dispersion so as to reflect them in a chosen direction, and at least one main reflector responsible for reflecting in a pointing direction of a chosen area the waves reflected in the chosen direction by the reflector array.

The antenna according to the invention may have other features and in particular, separately or in combination:

each reflector array may have a substantially planar or substantially parabolic wave-reflecting face, the phase-shifter cells may be of passive type. In this case each of them includes for example a substantially planar resonant structure comprising at least one upper patch placed substantially parallel to a lower ground plane, at a chosen distance, and including at least one slot, the dimensions of the patch and of the slot and the distance being chosen to impose the chosen phase-shift and the chosen frequency-phase dispersion on the waves to be reflected, at least one of the main reflectors may have a substantially parabolic wave-reflecting face, alternatively, at least one of the main reflectors may have a substantially parabolic or substantially plane wave-reflecting face on which is formed an etched reflector array including passive or active phase-shifter cells, for example of the type described hereinabove, if there are at least two main reflectors having different optical characteristics for reflecting in different pointing directions the waves reflected in the chosen direction by the reflector array, it comprises a loading device, coupled to the main reflectors and responsible for placing one of them in a chosen position relative to the reflector array, so as to reflect the waves reflected by that reflector array in its pointing direction, this other loading device may for example include at least one shaft on which the main reflectors are mounted to rotate at different angular positions enabling them to be positioned substantially one above the other in an initial position and responsible for driving at least one of the main reflectors selectively in rotation about this shaft so as to place it in the chosen position, alternatively, the loading device may for example include at least one housing (or magazine) in which the main reflectors are stored and holding and displacement means adapted to seize selectively one of the main reflectors in the housing so as to extract it from the latter and then to place it in the chosen position.

The invention is particularly well adapted, although not exclusively so, to geostationary telecommunication antennas in the Ku band (12 to 18 GHz) with reconfigurable coverage (in shape and in position), and to synthetic aperture radar (SAR) antennas, in particular in the C band (4 to 8 GHz) or in the X band (8 to 12 GHz).

Figure 5:
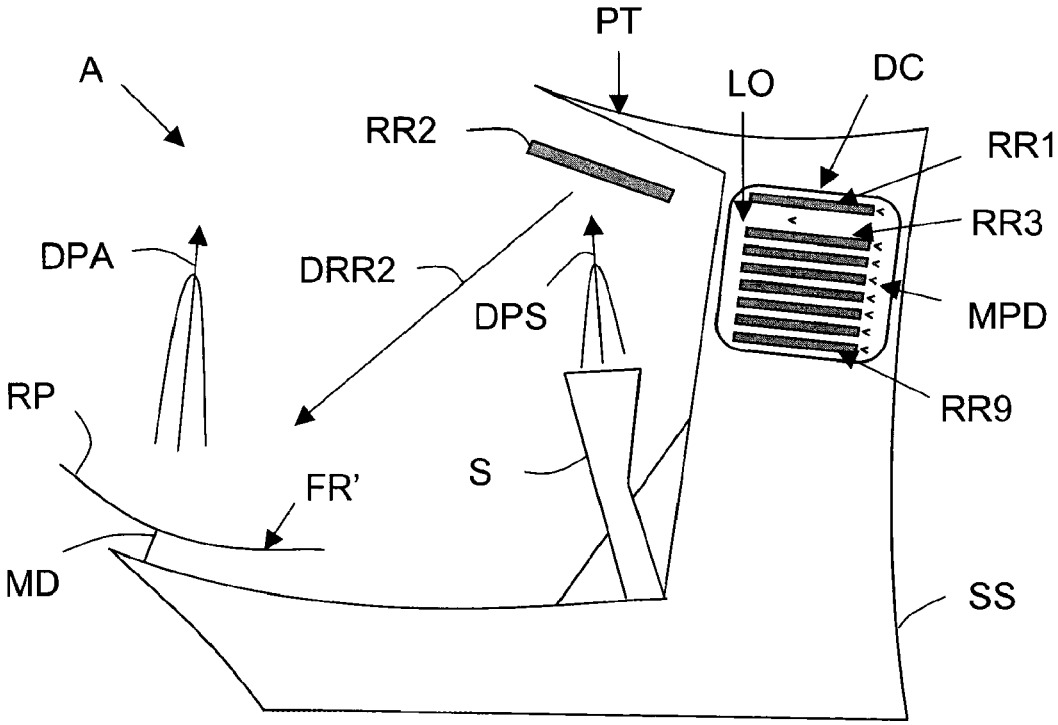
Figure 6:
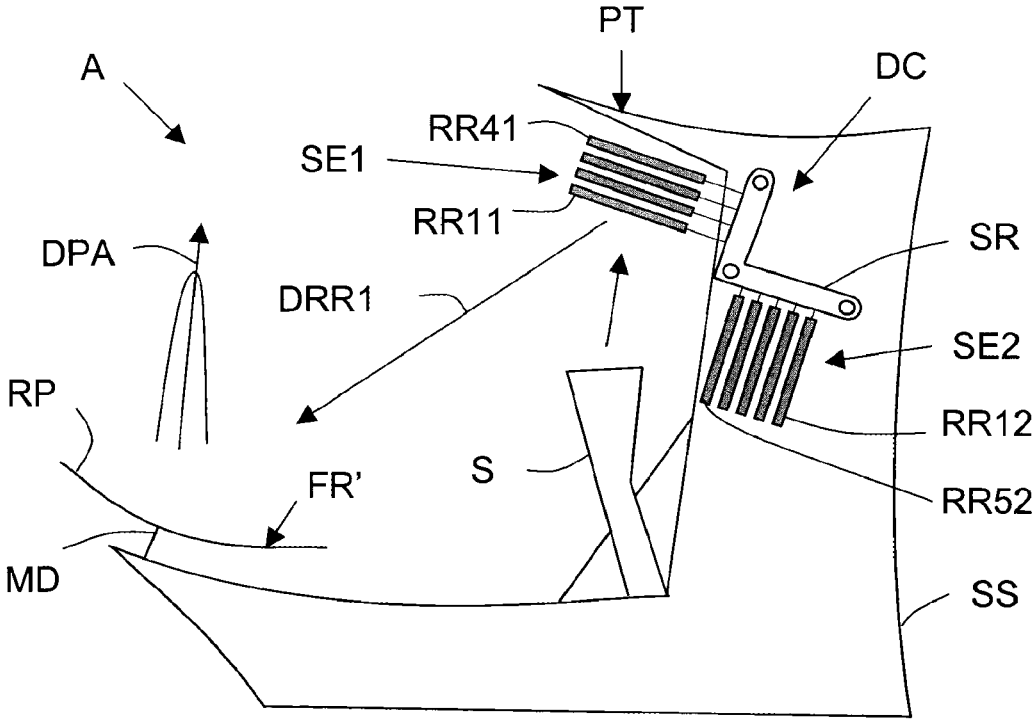
Figure 7:
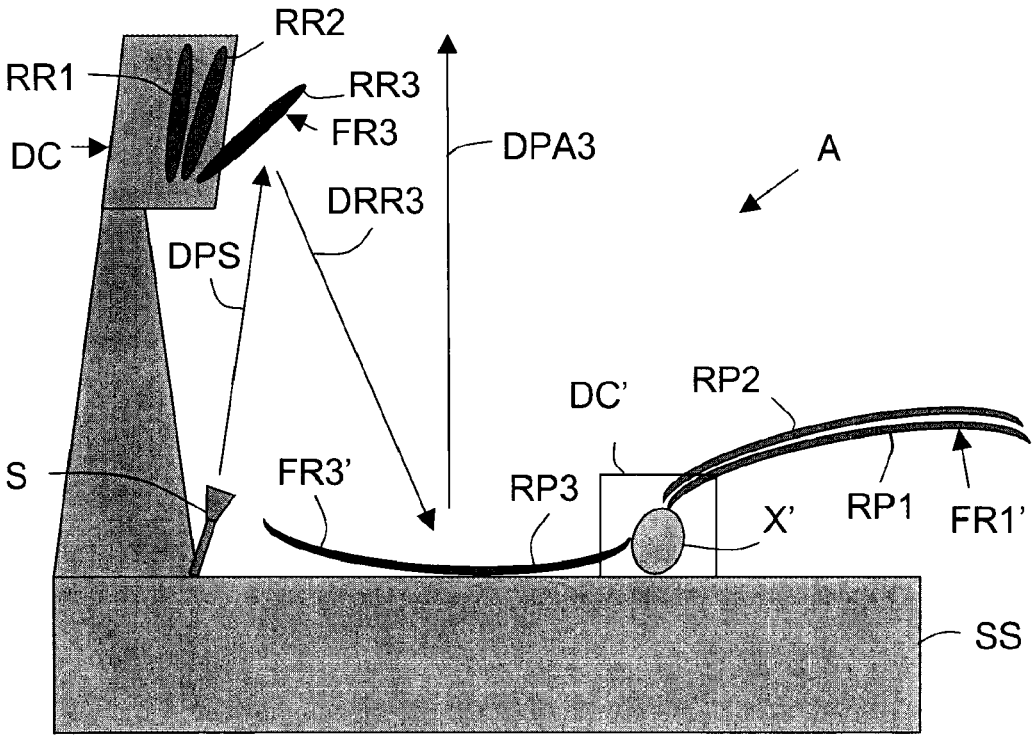
Figure 8:
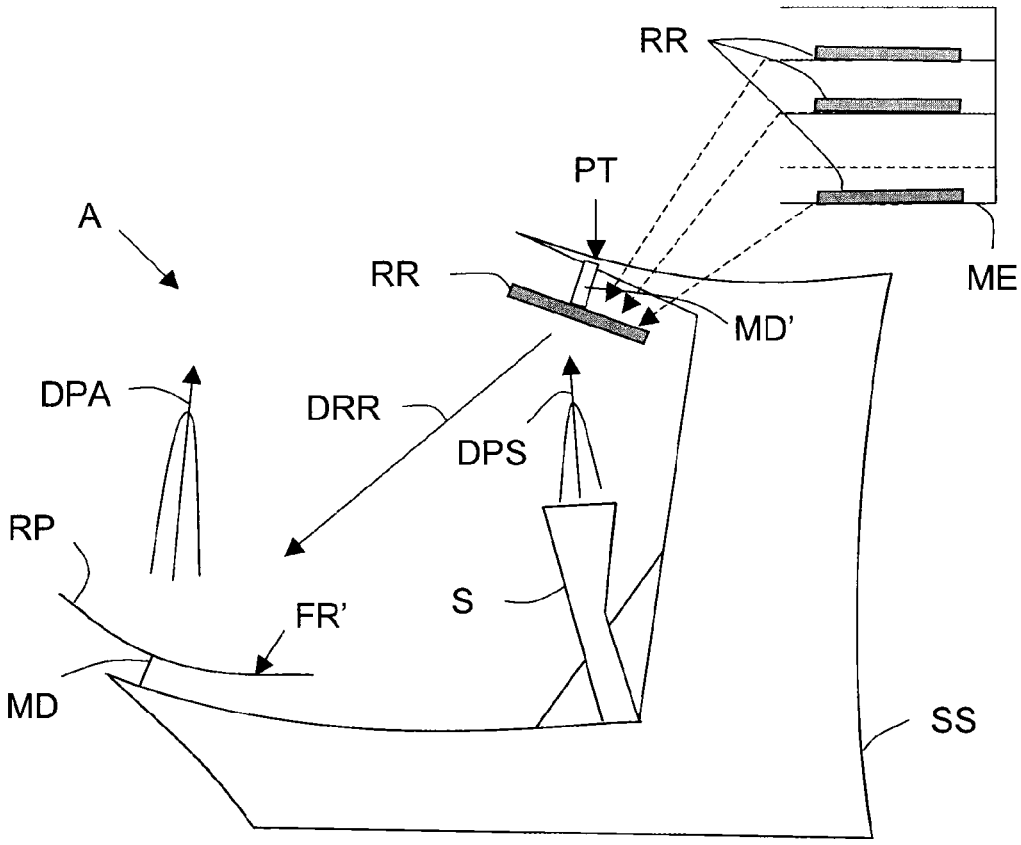
Figure 9:
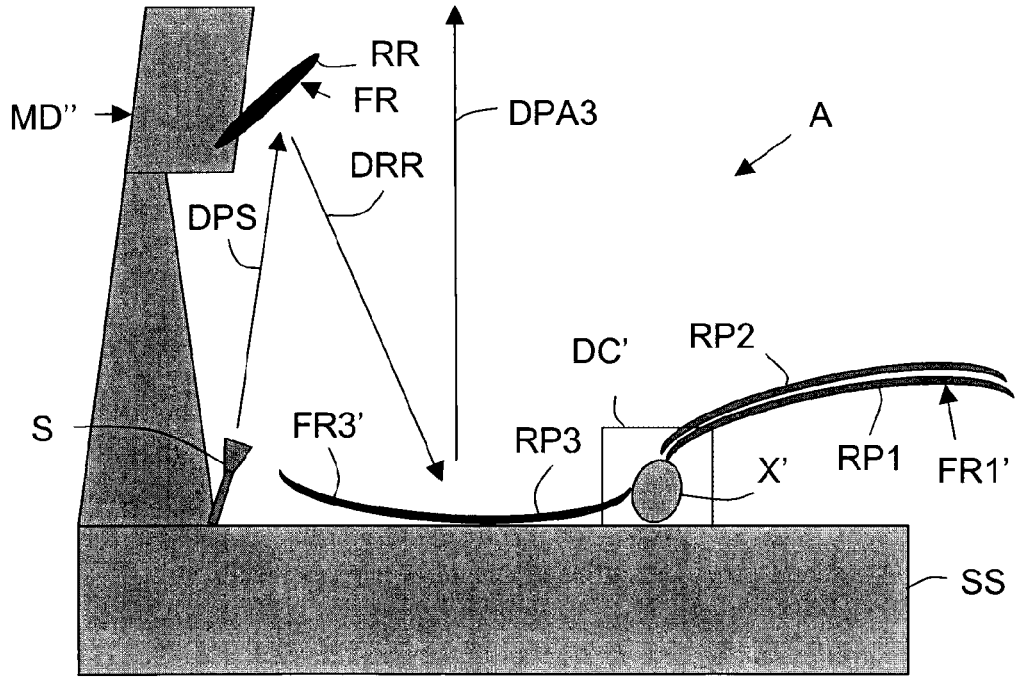

Other features and advantages of the invention will become apparent on reading the following detailed description and examining the appended drawings, in which:

FIG. 1 shows diagrammatically a first state of a first embodiment of a reconfigurable reflector array antenna according to the invention, FIG. 2 shows diagrammatically, in plan view, one embodiment of a phase-shifter cell, FIG. 3 is a view of the phase-shifter cell from FIG. 2 in cross section taken along the line III-III, FIG. 4 shows diagrammatically a second state of the first embodiment of a reconfigurable reflector array antenna according to the invention, FIG. 5 shows diagrammatically a second embodiment of a reconfigurable reflector array antenna according to the invention, FIG. 6 shows diagrammatically a first variant of the second embodiment of a reconfigurable reflector array antenna according to the invention, FIG. 7 shows diagrammatically a second variant of the second embodiment of a reconfigurable reflector array antenna according to the invention, FIG. 8 shows diagrammatically a third embodiment of a reflector array antenna according to the invention, and FIG. 9 shows diagrammatically a variant of the second embodiment of a reflector array antenna according to the invention.

The appended drawings constitute part of the description of the invention as well as contributing to the definition of the invention, if necessary.

FIGS. 1 to 3 are referred to first to describe a first embodiment of a reconfigurable reflector array antenna A according to the invention.

It is considered hereinafter that the antenna A is on board a geostationary telecommunication satellite in the Ku band (12 to 18 GHz). However, the invention is not limited to that application. In fact it concerns radar antennas on board satellites, possibly flying in formation, or on board aircraft or spacecraft, such as shuttles. Accordingly, the invention is well adapted to SAR antennas [synthetic aperture radar antennas, in the C band (4 to 8 GHz) or in the X band (8 to 12 GHz)].

In this first embodiment, the reflector array antenna A includes a support structure SS adapted to be fastened to a satellite (not shown) and to which is fixed firstly, at a chosen location, a primary source S responsible for delivering over a chosen solid angle having a main direction DPS, called the source pointing direction, waves comprising signals to be transmitted.

The source takes the form of a horn, for example.

The antenna A also includes a loading device (or mechanism) DC, partially fastened to the support structure SS, at a chosen other location, as well as a plurality of different and independent reflector arrays RRi (here i=1 to 3, but it may take any value greater than or equal to 2) fastened to the support structure SS via the loading device DC.

It is important to note that the various components of the antenna A are not necessarily installed on a support structure SS. They may in fact be installed in different locations on the satellite (or craft), fastened to each other.

Each reflector array RRi includes at least two phase-shifter cells CD responsible, when they are placed in a chosen position relative to the source S, for imposing on waves delivered by the latter a chosen phase-shift and if possible a chosen frequency-phase dispersion, in order to reflect them in a chosen direction DPA.

It is important to note that the phase-shift chosen and/or the frequency-phase dispersion chosen vary/varies from one reflector array RRi to the other RRi', so that the coverage area (or "spot") of the beam from the antenna A, and/or the shape of that area, varies as a function of the reflector array RRi selected.

Many types of phase-shifter cell may be envisaged.

For example, if a simple antenna A is required and/or a low antenna cost is required, the phase-shifter cells CD that are formed on the reflector arrays RRi are preferably of passive type. Even more preferably, and as shown in FIGS. 2 and 3, each phase-shifter cell CD may include a substantially planar resonant structure including at least one upper patch PS placed substantially parallel to a lower ground plane PM1, at a chosen distance, and including at least one slot FP. In this case, the dimensions of the patch(es) and the slot(s) and the distance(s) are chosen to impose the chosen phase-shift and the chosen frequency-phase dispersion on the waves to be reflected.

More precisely, in the example shown in FIGS. 2 and 3, the passive resonant structure CD comprises a substrate SB including a rear (or lower) face, fastened to a lower ground plane PM1, and a front (or upper) face, fastened to at least one upper patch (or patch [In English in the original—Tr.]) PS including at least one slot FP.

The upper patch PS is placed substantially parallel to the lower ground plane PM1 and has dimensions less than the latter's. For example, and as shown, the upper patch PS is of rectangular shape, and preferably of square shape.

Moreover, each slot FP is preferably of rectangular shape defined by two long (longitudinal) sides, of length b, and two short (transverse) sides, of width a. Each slot FP is produced by etching the ground plane constituting the upper patch PS, for example.

If the upper patch PS includes only one slot FP, the latter is preferably placed substantially at its center. Moreover, the upper patch PS may include a plurality of slots FP, possibly with different dimensions.

By judiciously choosing the dimensions of the upper patch PS, and in particular its length x, and of the slot FP, and in particular its length b, as well as the thickness of the substrate SB, it is possible to impose simultaneously a chosen phase-shift and a chosen frequency-phase dispersion.

The dimensions and thicknesses may be deduced from curves giving the evolution of the phase-shift 66 $\phi$ as a function of the length b of the slot FP, for a plurality of different values x of the length of the upper patch PS and for a thickness d' of the substrate SB (equal to about 2 mm, for example).

The substrate SB is made of Duroïd® or TMM®, for example, or as a multilayer structure (comprising, for example, a honeycomb type spacer, or a foam with a permittivity close to 1, between very thin substrates, on the upper face of which are etched metallic patterns and on the lower face of which is etched a ground plane), and has a small thickness d', typically of the order of $\lambda/10$ to $\lambda/5$, where $\lambda$ is the wavelength in a vacuum of the waves to be reflected, coming from the source of the antenna.

Such a phase-shifter cell CD enables any phase-shift to be obtained, and in particular phase-shifts (very much) greater than 360°. It also enables the frequency dispersion of this phase-shift to be controlled.

Utilizing on the different reflector arrays RRi phase-shifter cells CD with different characteristics, for example slots of different lengths, different current paths are obtained and different characteristic resonant lengths (or electrical lengths) of the upper patches PS are therefore obtained, enabling different phase-shifts of the reflected wave to be obtained.

It is important to note that the upper patch PS must be resonant at $\lambda/2$.

It is equally important to note that the use of passive reflector arrays, in particular of the type described hereinabove, enables a large number thereof to be carried on board, for example five, or even ten, and that their cost of fabrication is reduced. This results from the fact that they are very thin, typically of the order of one centimeter thick, and may all have identical dimensions and curvatures (often null curvatures in the case of the simplest plane reflector arrays), only their phase-shifter cells CD, placed on their upper reflecting face FRi, being different.

It is equally important to note that the phase-shifter cells may instead be of the active type. There may in particular be used active phase-shifter cells having a characteristic resonant length and comprising in one or more chosen locations a micron-scale electromechanical device, of MEMS (standing for "MicroElectroMechanical System") type, adapted to be placed in at least two different states for respectively allowing and prohibiting the establishing of a short circuit intended to vary the characteristic resonant length, in order to vary the phase-shift of the waves to be reflected that have at least one linear polarization.

These active cells are of particular benefit because they offer one or more supplementary degrees of freedom in terms of antenna reconfigurability. As will emerge later, they are particularly well adapted to the embodiments shown in FIGS. 8 and 9, of which more later.

Such active phase-shifter cells, just like the passive phase-shifter cells described hereinabove, are described in particular in the patent document FR 0450575.

It may be envisaged that certain reflector arrays include passive phase-shifter cells and certain other reflector arrays include active phase-shifter cells.

Any type of loading device DC enabling selection of one of the reflector arrays RRi, in order to place it in the chosen position enabling it to reflect waves in the antenna pointing direction DPA, may be envisaged.

Accordingly, in the example shown in FIG. 1, the loading device DC includes a shaft X on which the reflector arrays RR1 to RR3 are mounted to rotate. The angular positions of the three reflector arrays RRi relative to the shaft X are different so that they can be positioned substantially one above the other in an initial position.

The position in which a reflector array RRi must be placed may coincide with its position when all of the reflector arrays are in the initial position (shown in FIG. 1), but this is not obligatory. It may in fact be envisaged, in contradistinction to what is shown in FIG. 1, that the reflector arrays RRi are initially folded against the satellite (or the support structure SS), their reflecting face FRi then pointing toward the satellite, and that they must be driven in rotation toward the chosen position in order to place any one of them in the chosen position, its reflecting face FRi then being oriented toward the target coverage area.

In the situation shown in FIG. 1, for example, if it is required to use the first reflector array RR1, the three reflector arrays RR1 to RR3 remain in their initial position. If it is then required to use the second reflector array RR2, interleaved between the first reflector array RR1 and the third reflector array RR3, the first reflector array RR1 is driven in rotation toward the left so that it enables the reflecting face FR2 of the second reflector array RR2 to collect the waves delivered by the source S so as to reflect them (after phase-shifting adapted to the shape of the beam to be generated) in the direction of its own coverage area. This situation is shown in FIG. 4. Finally, if it is required to use the third reflector array RR3, the first reflector array RR1 and the second reflector array RR2 are driven in rotation toward the left so that they enable the reflecting face FR3 of the third reflector array RR3 to collect the waves delivered by the source S so as to reflect them (after phase-shifting adapted to the shape of the beam to be generated) in the direction of its own coverage area.

Of course, many other combinations of displacements of the reflector arrays RRi may be envisaged, as a function of the type of loading device used and its positioning relative to the source S. For example, the loading device DC may include at least one housing (or magazine) LO, defined in the support structure SS or by a casing fastened to the satellite, and in which are stored, for example in the form of a stack, the various reflector arrays RRi. In this case, the loading device DC includes a "holding" and displacement mechanism MPD responsible initially for seizing selectively, inside the housing LO, one of the reflector arrays RRi in order to extract it from the latter, and then placing it in the chosen position. Such a loading device DC is shown diagrammatically in FIG. 5, of which more later. In this embodiment, if it is required to use a reflector array RRi' other than that RRi placed in its chosen reflecting position, the holding and displacement mechanism MPD begins by seizing the reflector array RRI placed outside the housing LO in order to replace it inside the latter, and then seizes in the housing LO the new reflector array RRi' in order to extract it therefrom and then to place it in its chosen reflecting position.

In this first embodiment, the reflecting face FRi of the reflector arrays RRi may be substantially parabolic, as shown in FIGS. 1 and 4. However, in a variant, the reflecting face FRi of the reflector arrays RRi may be substantially plane.

It is important to note that the chosen reflecting position is not necessarily the same for all the reflector arrays RRi.

FIG. 5 is referred to now to describe a second embodiment of an antenna according to the invention. In this embodiment, the reflector array antenna A includes a main reflector RP in addition to its set of at least two reflector arrays RRi.

In this embodiment, the reflector array RRi, which is placed in its chosen reflecting position, is responsible for reflecting the waves coming from the source S after subjecting them to a chosen phase-shift and if possible a chosen frequency-phase dispersion. The main reflector RP is positioned to intercept the path of the waves reflected by the reflector array RRi used, in order to reflect them in turn (but with no phase-shift) in the antenna pointing direction DPA corresponding to said reflector array RRi used.

The wave-reflecting face FR' of the main reflector RP is substantially parabolic, for example, if it consists of a conventional reflector with no etching and not a reflector array.

However, planar reflector arrays RRi could be combined with a main reflector (RRP) also taking the form of a planar reflector array.

Elliptical reflector arrays RRi could also be used with a parabolic main reflector (RP) or with a planar main reflector array (RRP).

However, the solution offering the best mass/cost/performance combination uses a conventional parabolic main reflector RP (and therefore one without etching) and a plurality of interchangeable (secondary) reflector (sub-)arrays RRi, providing various phase laws and therefore various antenna diagrams.

The second embodiment is intended to remedy a drawback of the first embodiment. In fact, the different paths of the waves between the source S and the reflector array RRi used introduce a frequency dispersion that limits the bandwidth of the antenna A, and can be only partially compensated by the phase-shifter cells CD. For example, for use in the Ku band, the dimensions of the reflector arrays RRi must be less than 1 meter if stable performance is to be obtained over about 10% of the bandwidth. Using the reflector arrays as "sub-reflectors" of the main reflector RP eliminates the frequency dispersion.

Moreover, it is important to note that in this second embodiment the main function of the reflector arrays RRi is to determine the shape of the beam (and therefore of the coverage area (or spot)) and to generate low values of depointing; very high values of depointing may be provided by the main reflector RP. If this is the case, the main reflector RP is fastened to the support structure SS (or to the satellite) via a displacement mechanism MD adapted to control its depointing.

As shown in FIG. 5, thermal protection PT may be provided at the location in which the reflector array used, here RR2, is placed. This thermal protection PT may be constituted by (or on) a part of the support structure SS (or by an element attached thereto) or by an element attached to the satellite.

In the embodiment shown in FIG. 5, the loading device DC includes a housing (or magazine) LO, defined in the support structure SS and in which are stored in the form of a stack the various reflector arrays RRi (here i=1 to 9, for example). The loading device DC includes a holding and displacement mechanism MPD responsible for selectively seizing, inside the housing LO, one of the reflector arrays (for example RR2) in order to extract it from the latter, and then placing it in the chosen reflecting position that corresponds to its chosen reflection direction DRR2.

The holding and displacement mechanism MPD comprises a pusher mechanism, for example, responsible for extracting the reflector arrays RRi' inside the housing LO and responsible for conveying them into their chosen reflecting position, for example by means of rails, and for then returning them to the housing LO when that is required.

In this embodiment, if the reflector arrays RRi are responsible for determining the shape of the beam (and therefore of the coverage area (or spot)), while the main reflector RP is responsible for any depointing, reconfiguring the antenna A requires replacing one reflector array RRi by another reflector array RRi', by means of the loading device DC, and/or repositioning the main reflector RP, by means of its displacement mechanism MD.

Of course, a plurality of housings LOj could be provided (j being greater than or equal to 2) for storing subsets of reflector arrays RRij.

Moreover, as in the first embodiment, there may be envisaged many other combinations of displacements of the reflector arrays RRi, as a function of the type of loading device DC used and its position relative to the source S. It is therefore possible to use a loading device DC with a rotary shaft, of the type described hereinabove with reference to FIGS. 1 and 4.

Another variant loading device DC, shown in FIG. 6, may consist in mounting on a rotary support SR a plurality of subsets SEj of reflector arrays RRij (here j=1, 2, but may take any value greater than or equal to 1). The rotary support SR has a number j of rotary shafts Xj (not shown), for example, on each of which is mounted to rotate a subset SEj of reflector arrays RRij. To place a reflector array RRij in its chosen reflecting position, the rotary support SR is driven in rotation so that the subset SEj to which the selected reflector array RRij belongs is placed in the vicinity of the reflecting position, after which at least the selected reflector array RRij is driven in rotation about the shaft Xj so that it is placed in its chosen reflecting position and can reflect the waves emitted by the source S and apply to them the appropriate phase-shifts. This other variant may equally be applied to the first embodiment.

FIG. 7 is referred to now to describe a variant of the second embodiment described hereinabove with reference to FIGS. 5 and 6.

In this variant the antenna does not have a single main reflector RP, but a plurality of main reflectors RPk having different optical characteristics. In the example shown, k is equal to 3, but it may take any value greater than or equal to 2.

Each main reflector RPk is adapted to reflect in a chosen pointing direction DPAk the waves reflected in the chosen direction by the reflector array RRi (placed in its chosen position). Because of their different optical characteristics, the pointing directions DPAk of the main reflectors RPk are different.

The main reflectors RPk are coupled to another loading device DC' fastened to the support structure SS (as shown) or directly to the satellite. This other loading device DC' is responsible for placing one of the main reflectors RPk, which are coupled to it, in a chosen position relative to the selected reflector array RRi that is placed in its chosen reflecting position. Once the main reflector RPk has been placed, it can reflect the reflected waves (which are also phase-shifted by the reflector array RRi used) in its own pointing direction DPAk.

This loading device DC' may, like that DC responsible for the reflector arrays RRi, take any form provided that it is capable of selecting one of the main reflectors RPk in order to place it in the chosen position enabling it to reflect the waves in its own pointing direction DPAk.

Accordingly, in the example shown in FIG. 7, the loading device DC' includes a shaft X' on which are mounted to rotate the main reflectors RP1 to RP3. The angular positions of the three main reflectors RP relative to the shaft X' are different so that they can be positioned substantially one above the other in an initial position (not shown, but situated in the example shown in the right-hand part at the level of the second main reflector RP2 and the third main reflector RP3).

The position in which a main reflector RPk must be placed may coincide with its position when the set of main reflectors is in its initial position, but this is not obligatory, as shown in FIG. 7. Here, the main reflectors RPk are in fact initially folded against the satellite (or the support structure SS), their reflecting face FRk' then pointing toward the satellite, in the initial position. The loading device DC' must consequently drive them in rotation toward the left, toward their chosen reflecting positions, in order to place any one of them in its chosen reflecting position, its reflecting face FRk' then being oriented toward the reflector array RRi used and the target coverage area. The converse situation may equally be envisaged with the same loading device DC'. In fact, if the initial position of the main reflectors RPk is situated to the left of the shaft X', their reflecting faces FRk' are oriented toward the reflector array RRi used and the target coverage area, in said initial position. Consequently, if it is required to use the third main reflector RP3, the three main reflectors RP1 to RP3 remain in their initial position. If it is then required to use the second main reflector RP2, interleaved between the first main reflector RP1 and the third main reflector RP3, the third main reflector RP3 is driven in rotation toward the right in order to enable the reflecting face FR2' of the second main reflector RP2 to collect the waves reflected (and processed) by the reflector array used (for example RR1) so as to reflect them in the direction of its own coverage area. Finally, if it is required to use the first main reflector RP1, the third main reflector RP3 and the second main reflector RP2 are driven in rotation toward the right so that they enable the reflecting face FR1' of the first main reflector RP1 to collect the waves reflected (and processed) by the reflector array used (for example RR1) so as to reflect them in the direction of its own coverage area.

Of course, there may be envisaged many other combinations of displacements of the reflector arrays RRi, as a function of the type of loading device DC' used and its position relative to the reflector array RRi (when it is placed in its reflecting position). For example, the loading device DC' may include at least one housing (or magazine), defined in the support structure SS or by a casing fastened to the satellite, in which are stored, for example in the form of a stack, the various main reflectors RPk. In this case, the loading device DC' includes a holding and displacement mechanism responsible initially for selectively seizing, inside the housing, one of the main reflectors RPk in order to extract it from the latter, and then placing it in its chosen reflecting position. In this other embodiment, if it is required to use a main reflector RPk' other than that RPk placed in its chosen reflecting position, the holding and displacement mechanism begins by seizing the main reflector RPk placed outside the housing in order to replace it inside the latter, and then seizes in the housing the new main reflector RPk' in order to extract it from the latter and then to place it in its chosen reflecting position.

It is important to note that the chosen reflecting position is not necessarily the same for all the main reflectors RPk.

In the variant of the second embodiment shown in FIG. 7, the reflecting face FRk' of the main reflectors RPk may be either substantially parabolic or substantially plane. Moreover, in this variant, any type of loading device DC may be used enabling selection of one of the reflector arrays RRi in order to place it in its chosen reflecting position enabling it to reflect the waves (in its chosen reflection direction DRRi), and in particular those described above with reference to FIGS. 1, 5 and 6.

It is equally important to note that at least one of the main reflectors (RRPk), or even all of them, may take the form of a parabolic or planar reflector array.

FIGS. 8 and 9 will be referred to now to describe a third embodiment of a reflector array antenna A according to the invention.

What distinguishes this third embodiment from the second one (shown in FIGS. 5 to 7) is the fact that the antenna A now has only one single reflector array RR, preferably mounted on a displacement mechanism MD" fastened to the support structure SS (or to the satellite).

In the embodiment shown in FIG. 8, the antenna A further includes, as in the embodiment shown in FIG. 5, one single main reflector RP mounted on a displacement mechanism MD.

The mode of operation of this antenna A is therefore identical to that of the antenna shown in FIG. 5 (once one of its reflector arrays has been selected and placed in its chosen reflecting and phase-shifting position). Consequently, the reflector array RR is responsible for reflecting the waves coming from the source S after they have been subjected to a chosen phase-shift and if possible a chosen frequency-phase dispersion. The main reflector RP is positioned to intercept the path of the waves reflected by the reflector array RR, in order to reflect them in turn (but with no phase shift) in the antenna pointing direction DPA corresponding to the reflector array RR.

This antenna pointing direction DPA may be chosen by means of the displacement mechanism MD" of the reflector array RR and/or the displacement mechanism MD of the main reflector RP.

Moreover, because in this embodiment the shape of the coverage area cannot be modified once the antenna has been positioned in orbit (unless active phase-shifter cells (for example of the MEMS type) are used), this shape is initially chosen as a function of what is required just before the start of a mission. To do this, there is preferably provided for each antenna A a plurality of reflector arrays RR having different phase-shifts and/or different frequency-phase dispersions, therefore corresponding to different coverage areas (or "spots") and/or to different coverage area shapes. These various reflector arrays RR, which have been tested and are therefore all ready to be installed, are stored in a magazine ME external to the antenna A, for example, as shown in FIG. 8. There may equally be provided for each antenna A a plurality of different main reflectors having different optical properties. When the mission has been finalized, a choice is made from among the various reflector arrays (where applicable stored in the external magazine ME), and where applicable from among the various main reflectors, of that (or those) that correspond to it.

It is important to note that not all the reflector arrays stored in the external magazine ME necessarily include only passive phase-shifter cells or only active phase-shifter cells. In fact, certain reflector arrays may include passive phase-shifter cells whereas other reflector arrays include active phase-shifter cells.

In this embodiment, and if there are passive phase-shifter cells, the reconfigurability of the antenna A therefore results from the choice of reflector arrays, and where applicable from the choice of main reflectors, effected just before the start of the mission.

If there are active phase-shifter cells, for example of the MEMS type, the reconfigurability of the antenna A results both from the choice of the reflector arrays, and where applicable the choice of the main reflectors, effected just before the start of the mission, and also on the states in which the active phase-shifter cells are placed during the mission.

The wave-reflecting face FR' of the main reflector RP is substantially parabolic, for example, if it is of the conventional type without etching and therefore does not constitute a reflector array.

However, a planar reflector array RR may be combined with a main reflector RRP also taking the form of a planar reflector array.

An elliptical reflector array RR could also be used with a parabolic main reflector RP or with a planar main reflector array RRP.

In the embodiment shown in FIG. 9, as in the embodiment shown in FIG. 7, the antenna A comprises a plurality of main reflectors RPk (or RRPk) having different optical characteristics. In the embodiment shown, k is equal to 3, but may take any value greater than or equal to 2.

Each main reflector RPk (or RRPk) is adapted to reflect in a chosen pointing direction DPAk the waves reflected in the chosen direction by the reflector array RR. Because of their different optical characteristics, the pointing directions DPAk of the main reflectors RPk are different.

The main reflectors RPk (or RRPk) are coupled to a loading device DC' fastened to the support structure SS (as shown) or directly to the satellite. This loading device DC' is responsible for placing one of the main reflectors RPk, which are coupled to it, in a chosen position relative to the reflector array RR. Once the main reflector RPk has been placed, it can reflect the reflected waves (which are also phase-shifted by the reflector array RR) in its own pointing direction DPAk.

This loading device DC' being of the same type as that described hereinabove with reference to FIG. 7, it will therefore not be described again, and likewise the mode of selection of the main reflector RPk, which is identical to the previous one. Moreover, there may be envisaged many modes of displacement of the main reflectors RPk as a function of the type of loading device DC' used and its positioning relative to the reflector array RR. More generally, everything stated with regard to the main reflectors of FIG. 7 applies equally to the main reflectors of FIG. 9.

The invention is not limited to the antenna embodiments described hereinabove, by way of example only, but encompasses all variants that the man skilled in the art might envisage within the scope of the following claims.

The invention claimed is:

1. Reflector array antenna (A), characterized in that the antenna comprises:

a source (S) adapted to deliver signals in the form of waves, at least two different and independent reflector arrays (RRi) each comprising at least two phase-shifter cells (CD) adapted to impose on said waves delivered by the source (S) a chosen phase-shift and a chosen frequency-phase dispersion, said chosen phase-shift and/or said chosen dispersion varying from one reflector array (RRi) to the other of said reflector arrays, and a loading device (DC) coupled to said reflector arrays (RRi) and adapted to alternately place each of said reflector arrays in a chosen position relative to said source (S) so that the waves that said source delivers are subjected to the phase-shift and the frequency-phase dispersion imposed by said phase-shifter cells of said placed reflector array (CD), so as to be reflected in a chosen direction.

2. The antenna according to claim 1, characterized in that said reflector arrays (RRi) have a substantially planar wave-reflecting face (FR).

3. The antenna according to claim 1, characterized in that said reflector arrays (RRi) have a substantially parabolic wave-reflecting face (FR).

4. The antenna according to claim 1, characterized in that said loading device (CD) includes at least one shaft (X) on which said reflector arrays (RRi) are mounted to rotate at different angular positions enabling said reflector arrays to be positioned substantially one above the other of said reflector arrays in an initial position and adapted to drive at least one of said reflector arrays (RRi) selectively in rotation about said shaft (X) so as to place said at least one of said reflector arrays in said chosen position.

5. The antenna according to claim 1, characterized in that said loading device (CD) includes at least one housing (LO) in which said reflector arrays (RRi) are stored and holding and displacement means (MPD) adapted to seize selectively one of said reflector arrays (RRi) in said housing (LO) so as to extract said one of said reflector arrays from said housing (LO) and then to place said one of said reflector arrays in said chosen position.

6. The antenna according to claim 1, characterized in that said chosen direction is a pointing direction (DPA) of a chosen area.

7. The antenna according to claim 1, characterized in that further comprising at least one main reflector (RPk; RRPk) adapted to reflect in a pointing direction of a chosen area the waves reflected in said chosen direction by said reflector array (RRi) placed in said chosen position.

8. The antenna according to claim 7, characterized in that at least one of said main reflectors (RPk) has a substantially parabolic wave-reflecting face (FR').

9. The antenna according to claim 7, characterized in that at least one of said main reflectors (RRPk) has a substantially plane wave-reflecting face (FR') on which is formed an etched reflector array comprising at least two phase-shifter cells (CD).

10. The antenna according to claim 9, characterized in that the antenna comprises at least two main reflectors (RRPk) having a wave-reflecting face (FR') on which is formed an etched reflector array, comprising at least two phase-shifter cells (CD), and adapted to reflect in different pointing directions (DPAk) the waves pre-formed by said reflector array (RRi) placed in said chosen position, and another loading device (DC'), coupled to said main reflectors (RRPk) and adapted to place one of said main reflectors in a chosen position relative to said reflector array (RRi), so as to reflect the waves reflected by that reflector array (RRi) in the pointing direction of said reflector array.

11. The antenna according to claim 10, characterized in that said another loading device (DC') includes at least one shaft (X') on which said main reflectors (RPk; RRPk) are mounted to rotate at different angular positions enabling main reflectors to be positioned substantially one above the other in an initial position and adapted to drive at least one of said main reflectors (RPk; RRPk) selectively in rotation about said shaft (X') so as to place said at least one of said main reflectors in said chosen position.

12. The antenna according to claim 10, characterized in that said other loading device (DC') includes at least one housing in which said main reflectors (RPk; RRPk) are stored and holding and displacement means adapted to seize selectively one of said main reflectors (RPk; RRPk) in said housing so as to extract said one of said main reflectors from said housing and then to place in said chosen position.

13. The antenna according to claim 7, characterized in that the antenna comprises at least two main reflectors (RPk), having different optical characteristics adapted to reflect in different pointing directions (DPAk) the waves reflected in said chosen direction by said reflector array (RRi) placed in said chosen position, and another loading device (DC'), coupled to said main reflectors (RRk) and adapted to place one of said main reflectors in a chosen position relative to said reflector array (RRi), placed in said chosen position, so as to reflect the waves reflected by that reflector array (RRi) in the pointing direction of said reflector array.

14. The antenna according to claim 1, characterized in that said phase-shifter cells (CD) of at least some of said reflector arrays (RRi) are of passive type.

15. The antenna according to claim 14, characterized in that each passive phase-shifter cell (CD) includes a substantially planar resonant structure comprising at least one upper patch (PS) placed substantially parallel to a lower ground plane (PM1), at a chosen distance, and including at least one slot (FP), the dimensions of the patch (PS) and of the slot (FP) and said distance being chosen to impose said chosen phase-shift and said chosen frequency-phase dispersion on the waves to be reflected.

16. The antenna according to claim 1, characterized in that said phase-shifter cells (CD) of at least some of said reflector arrays (RRi) are of active type.

17. The antenna according to claim 16, characterized in that each active phase-shifter cell (CD) has a characteristic resonant length and comprises in at least one chosen location a micron-scale scale electromechanical device, of MEMS type, adapted to be placed in at least two different states respectively allowing and prohibiting the establishing of a short circuit intended to vary said resonant length, so as to vary the phase-shift applied to said waves to be reflected in said chosen direction.

18. Reflector array antenna (A), characterized in that the antenna comprises:

a source (S) adapted to deliver signals in the form of waves, a reflector array (RRi) comprising at least two phase-shifter cells (CD) adapted to impose on said waves delivered by the source (S) a chosen phase-shift and a chosen frequency-phase dispersion so as to reflect said waves in a chosen direction, and at least two main reflectors (RPk; RRPk) adapted to reflect in a pointing direction (DPAk) of a chosen area the waves reflected in said chosen direction by said reflector array (RRi), and a loading device (DC'), coupled to said main reflectors (RRPk) and adapted to place one of said main reflectors in a chosen position relative to said reflector array (RRi), so as to reflect the waves reflected by that reflector array (RRi) in a pointing direction of said reflector array.

19. The antenna according to claim 18, characterized in that said reflector array (RRi) has a substantially planar wave-reflecting face (FR).

20. The antenna according to claim 18, characterized in that said reflector array (RRi) has a substantially parabolic wave-reflecting face (FR).

21. The antenna according to claim 18, characterized in that at least one of said main reflectors (RPk) has a substantially parabolic wave-reflecting face (FR').

22. The antenna according to claim 18, characterized in that at least one of said main reflectors (RRPk) has a substantially parabolic or substantially plane wave-reflecting face (FR') on which is formed an etched reflector array comprising at least two phase-shifter cells.

23. The antenna according to claim 22, characterized in that said at least two main arrays (RRPk) comprise a wave-reflecting face (FR') on which an etched reflector array is formed and adapted to reflect in different pointing directions (DPAk) the waves pre-formed by said reflector array (RRi).

24. The antenna according to claim 23, characterized in that said loading device (DC') includes at least one shaft (X') on which said main reflectors (RPk; RRPk) are mounted to rotate at different angular positions enabling said main reflectors to be positioned substantially one above the other in an initial position and adapted to drive at least one of said main reflectors (RPk; RRPk) selectively in rotation about said shaft (X') so as to place said at least one of said main reflectors in said chosen position.

25. The antenna according to claim 23, characterized in that said loading device (DC') includes at least one housing in which said main reflectors (RPk; RRPk) are stored and holding and displacement means adapted to seize selectively one of said main reflectors (RPk; RRPk) in said housing so as to extract said one of said main reflectors from said housing and then to place said one of said main reflectors in said chosen position.

26. The antenna according to claim 18, characterized in that at least some of said phase-shifter cells (CD) are of passive type.

27. The antenna according to claim 26, characterized in that each passive phase-shifter cell (CD) includes a substantially planar resonant structure comprising at least one upper patch (PS) placed substantially parallel to a lower ground plane (PM1), at a chosen distance, and including at least one slot (FP), the dimensions of the patch (PS) and of the slot (FP) and said distance being chosen to impose said chosen phase-shift and said chosen frequency-phase dispersion on the waves to be reflected.

28. The antenna according to claim 18, characterized in that at least some of said phase-shifter cells (CD) are of active type.

29. The antenna according to claim 28, characterized in that each active phase-shifter cell (CD) has a characteristic resonant length and comprises in at least one chosen location a micron-scale scale electromechanical device, of MEMS type, adapted to be placed in at least two different states for respectively allowing and preventing the establishing of a short circuit intended to vary said resonant length so as to vary the phase-shift applied to said waves to be reflected in said chosen direction.

30. The antenna according to claim 18, characterized in that at least some of said phase-shifter cells (CD) are of passive type, and further characterized in that said at least two main reflectors (RPk) have different optical characteristics adapted to reflect in different pointing directions (DPAk) the waves reflected in said chosen direction by said reflector array (RRi).

* * * * *